US009527703B2

(12) United States Patent
Herrmann

(10) Patent No.: US 9,527,703 B2
(45) Date of Patent: Dec. 27, 2016

(54) LIFTING DEVICE AND LIFTING PLATFORM WITH SUCH A LIFTING DEVICE

(71) Applicant: HERRMANN AG, Pösing (DE)

(72) Inventor: Johannes Herrmann, Pösing (DE)

(73) Assignee: HERRMANN AG (DE)

( * ) Notice: Subject to any disclaimer, the term of this patent is extended or adjusted under 35 U.S.C. 154(b) by 112 days.

(21) Appl. No.: 14/327,958

(22) Filed: Jul. 10, 2014

(65) Prior Publication Data

US 2015/0014616 A1 Jan. 15, 2015

(30) Foreign Application Priority Data

Jul. 10, 2013 (DE) ..... 10 2013 107 305

(51) Int. Cl.

| | |
|---|---|
| ***B66F 7/10*** | (2006.01) |
| ***B66F 3/46*** | (2006.01) |
| ***B66F 3/26*** | (2006.01) |
| ***B66F 7/20*** | (2006.01) |
| ***B66F 7/28*** | (2006.01) |
| ***F15B 11/22*** | (2006.01) |
| ***F15B 15/14*** | (2006.01) |

(52) U.S. Cl.

CPC . *B66F 3/46* (2013.01); *B66F 3/26* (2013.01); *B66F 7/20* (2013.01); *B66F 7/28* (2013.01); *F15B 11/22* (2013.01); *F15B 15/1404* (2013.01); *F15B 2211/782* (2013.01)

(58) Field of Classification Search

USPC ..... 254/89 H

See application file for complete search history.

(56) References Cited

U.S. PATENT DOCUMENTS

| | | | | |
|---|---|---|---|---|
| 1,614,790 A * | 1/1927 | Halstead | B66B 9/04 | 254/93 L |
| 1,815,907 A * | 7/1931 | Halstead | B66F 7/18 | 254/93 L |
| 1,864,325 A * | 6/1932 | Steedman | B66F 7/16 | 254/93 R |
| 1,919,156 A * | 7/1933 | Banning, Jr. | B66F 7/18 | 254/93 L |
| 1,958,960 A * | 5/1934 | Warner | B66F 7/16 | 254/93 L |
| 2,402,265 A * | 6/1946 | Thompson | B66F 7/18 | 91/1 |
| 3,085,785 A * | 4/1963 | Peterson | B66F 7/16 | 254/89 H |
| 3,447,421 A * | 6/1969 | Pelouch | B66F 3/42 | 91/4 A |
| 3,567,420 A * | 3/1971 | Legator, et al. | A01N 3/08 | 424/78.17 |
| 6,571,919 B1 * | 6/2003 | Stewart | B66F 7/16 | 187/205 |

* cited by examiner

*Primary Examiner* — Alvin Grant

(74) *Attorney, Agent, or Firm* — Hayes Soloway P.C.

(57) ABSTRACT

A pneumatically or hydraulically activated lifting device has a main carrier with a first cavity having a first lifting element arranged inside the first cavity. The main carrier also has a second cavity arranged in fixed movement with respect to the first cavity. A second lifting element is arranged inside this second cavity and is movable in the two mutually opposed directions of movement with respect to this cavity.

10 Claims, 5 Drawing Sheets

LIFTING DEVICE AND LIFTING PLATFORM WITH SUCH A LIFTING DEVICE

BACKGROUND OF THE INVENTION DESCRIPTION

The present invention relates to a lifting device capable of being acted upon by a flowable medium, and in particular to a hydraulically or pneumatically actuated lifting device. In this case the invention is described, in particular, with reference to a lifting platform for the lifting of motor vehicles, but it is pointed out that the apparatus according to the invention can also be used for other lifting apparatus or even lifting apparatus for articles other than motor vehicles.

Lifting platforms of this type have long been known from the prior art. In this case, a distinction is made, in particular, between underfloor lifting platforms and overfloor lifting platforms. In the case of overfloor lifting platforms substantially the entire lifting mechanism is arranged above the floor level. This means that if relatively great lifting heights have to be overcome, suitable lifting stamps for example have to be relatively long in order to reach these lifting heights. In this way, the structural space will as a rule also turn out to be relatively large in a vertical direction.

The object of the present invention is therefore to reduce the structural space of lifting devices of this type, in particular in a vertical direction.

SUMMARY OF THE INVENTION

A lifting device according to the invention capable of being actuated by a flowable medium has a main carrier which forms a first cavity, and a first lifting element which is arranged at least locally inside this first cavity and which is movable in two mutually opposed directions of movement with respect to this cavity. In addition, the lifting device has a (supply) opening in order to supply the flowable medium to the first cavity (or to remove it from the first cavity—in particular for lowering an article), in which case the first lifting element is moved in the first direction of movement by a supply of the flowable medium into the first cavity.

According to the invention the main carrier has a second cavity which is arranged in a manner fixed in terms of flow with respect to the first cavity, and a second lifting element which is arranged at least locally inside the second cavity and which is movable in the two mutually opposed directions of movement with respect to this second cavity. In addition, a second opening, and in particular a supply or removal opening, is also provided in order to supply the flowable medium to the second cavity or to remove it therefrom, in which case the second lifting element is moved in the second direction of movement (which is opposite the first direction of movement) by a supply of the flowable medium into the second cavity. It is preferable for the boundary walls of the cavities to be fixed in terms of flow with respect to each other.

The flowable medium is, in particular, a hydraulic medium or a pneumatic medium, it being in a particularly preferred manner a hydraulic medium such as for example oil or water or the like. It is preferable for the main carrier to have at least one wall which separates the two cavities from each other. In this case this wall preferably extends in a direction of movement of the lifting elements.

It is therefore proposed that, by a supply means for example a simultaneous supply of the flowable medium, it is possible for the lifting elements to be moved out in the two directions which are opposed to each other. In the case of a further advantageous embodiment at least one aerating valve is provided in order to aerate at least one cavity and/or at least one supply channel for supplying the flowable medium.

In order to reduce the structural space it is therefore proposed that with an expansion of the lifting device the two lifting elements should be moved out of the main carrier in the opposite direction. In this way, structural space can be saved as a whole since a length of the aforesaid main carrier can be kept shorter in the direction of movement than if only one lifting element is moved out in one direction.

In the case of a preferred embodiment the first cavity and the second cavity are connected to each other in terms of flow at least indirectly by means of at least one line conveying the flowable medium. In this case "indirectly" is to be understood as meaning that the flow connection can also be effected by way of a second lifting device and for example a first cavity of the first lifting device is connected in terms of flow to a second cavity of the second lifting device. It is also possible, however, for a connecting member and/or a connecting line to be provided, which connects the two cavities of a lifting device to each other hydraulically. In addition, it would also be possible for the connection to be made through an opening or a gap in or at the edge of a wall which separates the cavities from each other.

In the case of this embodiment the lifting elements therefore move inside the cavity or cavities of the main carrier. Conversely, however, it would also be possible for the main carrier to be received by the lifting elements and therefore for the lifting elements also to form the corresponding cavities for receiving the main carrier. In this case the first and the second lifting element would form cavities in each case and these could be acted upon with the flowable medium, in which case a movement of the lifting elements with respect to the carrier is made possible by acting upon the respective cavities.

In the case of a preferred embodiment the lifting device is a hydraulically operated lifting device and in this case it is preferable, as mentioned above, for the flowable medium to be a liquid, in particular oil or water.

In the case of a further advantageous embodiment at least one lifting element is arranged so as to be stationary. In this case it is possible for a lifting element for example to be fastened to a floor, for the main carrier to be arranged in turn on this lifting element and for the second lifting element to be arranged in turn on the main carrier. In this way, when the article is lifted or when the lifting device is moved out respectively, both the main carrier and the second lifting element are moved (with respect to the main carrier). In this case it is possible for the absolute speed of the movement of the second lifting element to be twice as great as the speed of movement of the main carrier. This is not absolutely necessary, however, since this can also be arranged differently in a manner dependent upon a cross-section of the respective lifting elements.

In the case of a further advantageous embodiment at least one lifting element has a channel for conveying a flowable medium, and in particular a hydraulic medium. In this case this channel can preferably be formed in a main body of the lifting element. It is preferable for this channel to extend in the direction of movement mentioned above.

In the case of a further advantageous embodiment the apparatus has at least one aerating valve for aerating this channel. In this case this aerating valve can be arranged for example between one end of this channel and a region of the lifting device.

In the case of a further advantageous embodiment the first cavity has a first chamber as well as a second chamber, which are separated from each other by a piston element of the first lifting element. This means that in the event of a movement of the lifting element with respect to the main carrier or with respect to the cavity respectively, the volume of one chamber is altered, for example is reduced, to the same degree as the volume of the other chamber (in this case increased). In this case it is advantageous for the second chamber to be connected in terms of flow to the second cavity mentioned above. In this way, it is advantageous for the second chamber likewise to have an opening by way of which the flowable medium can be supplied and/or removed.

The present invention further relates to an apparatus for the lifting of objects and, in particular, of motor vehicles. This apparatus has a carrier which has at least one carrying element to be arranged at least indirectly on the element to be lifted as well as at least one lifting device of the type described above. In this case the carrying element is coupled at least indirectly to a lifting element of the lifting device. This means that the aforesaid carrying element is also moved with a movement of the lifting element.

In the case of a further advantageous embodiment the apparatus also has a housing inside which the lifting device is arranged. It is advantageous for the apparatus to be an overfloor lifting platform, i.e. a lifting platform of which the mechanical elements are arranged at least to a large extent above a floor level.

In the case of a further advantageous embodiment the apparatus has a guide device for guiding a movement of the main carrier. In this case for example the main carrier can be guided inside a housing and, in this way, in particular a movement can be guided in the vertical direction of this main carrier.

In the case of a further advantageous embodiment the apparatus has a second lifting device and it is preferable for a connecting line to be provided in order to convey the flowable medium from the first lifting device to the second lifting device. In this embodiment for example one lifting device, which is provided in each case with carrying elements, can be provided in each case on both sides of the article to be lifted. In this way, it is preferable for these two lifting devices to be coupled to each other by way of the flow medium, and in a particularly preferred manner hydraulically.

In this way, as compared to apparatus according to the prior art, not only is a central supply provided which supplies the flowable medium to the two lifting devices, but a line for the flowable medium leads from one lifting device to the other lifting device. It is advantageous for two connecting lines to be provided which connect the two lifting devices to each other. In this case it is possible for the movement of the lifting elements to be designed in each case in the form of a master/slave drive in the case of the individual lifting devices, i.e. for the movement of a lifting element with respect to the main carrier also to generate the movement of the other lifting element (in particular of another lifting device).

In the case of a preferred embodiment the second lifting device is also a lifting device of the type described above and it is preferable for a first lifting element of the first lifting device to be connected to a second lifting element of the second lifting device by way of a first connecting line for the flowable medium. In particular, a symmetrical design is created between the two lifting devices. In this case it is possible for two central supply lines to be provided in order to supply the hydraulic medium in each case to the apparatus, in which case it is preferable for the supply means to supply the hydraulic medium to the first lifting device and for the second supply line to supply the hydraulic medium to the second lifting device and, in addition, it is preferable for the two lifting devices to be connected to each other by way of connecting lines.

BRIEF DESCRIPTION OF THE DRAWINGS

Further advantages and embodiments are evident from the accompanying drawings. In the drawings

DETAILED DESCRIPTION OF THE INVENTION

Figure 1:
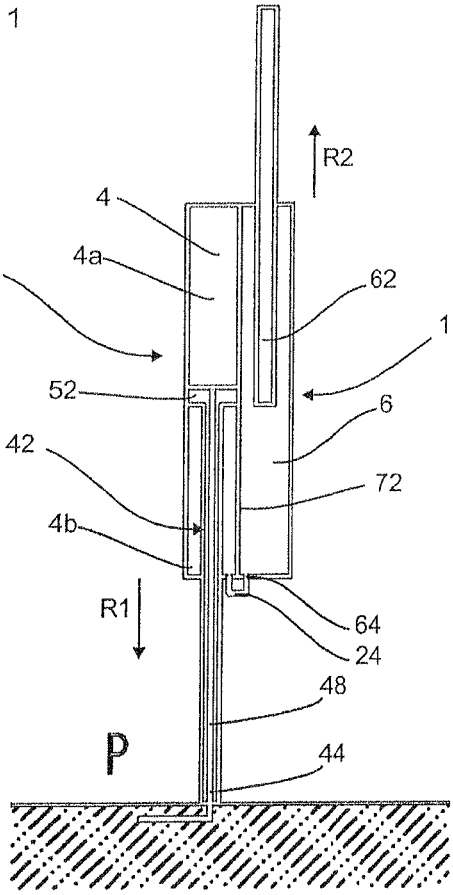
FIG. 1 is an illustration of a lifting device according to the invention.

FIG. 1 is a diagrammatic illustration of a lifting device 1 according to the invention. This lifting device 1 has in this case a main carrier 2 which can be designed in the form of a housing and on or in which are arranged in turn a first lifting element 42 and a second lifting element 62. In this case these two lifting elements 42, 62 are movable with respect to this main carrier 2 in the two directions R1 and R2 opposed to each other.

In FIG. 1 the situation is shown in which the lifting device is moved out, i.e. the first lifting element is moved downwards with respect to the main carrier 2 and the second lifting element 62 is moved in the direction R2, i.e. upwards, with respect to the main carrier. The reference number 44 designates a supply opening, or in general a supply device, which is illustrated in this case at the lower end of the lifting element 42. The reference number 48 designates a channel which extends in the interior of the lifting element 42 and by way of which a hydraulic medium—in this case for lifting upwards—can be conveyed and can enter a cavity 4 or the part 4*a* of the cavity respectively.

As a result of this supply of hydraulic medium the carrier 2 is moved upwards with respect to the lifting element 42, since the first lifting element 42 is anchored to the floor in a fixed manner. The hydraulic medium is conveyed out of the lower partial space 4*b* by way of a connecting line 24 and a supply opening 64 into the cavity 6. As a result, the second lifting element in turn is moved upwards, i.e. is forced out of the carrier 2. This connecting line can also, however, be formed inside the main carrier and in the simplest case can be formed by an opening in the wall 72 in the interior of the main carrier 2.

Figure 2:
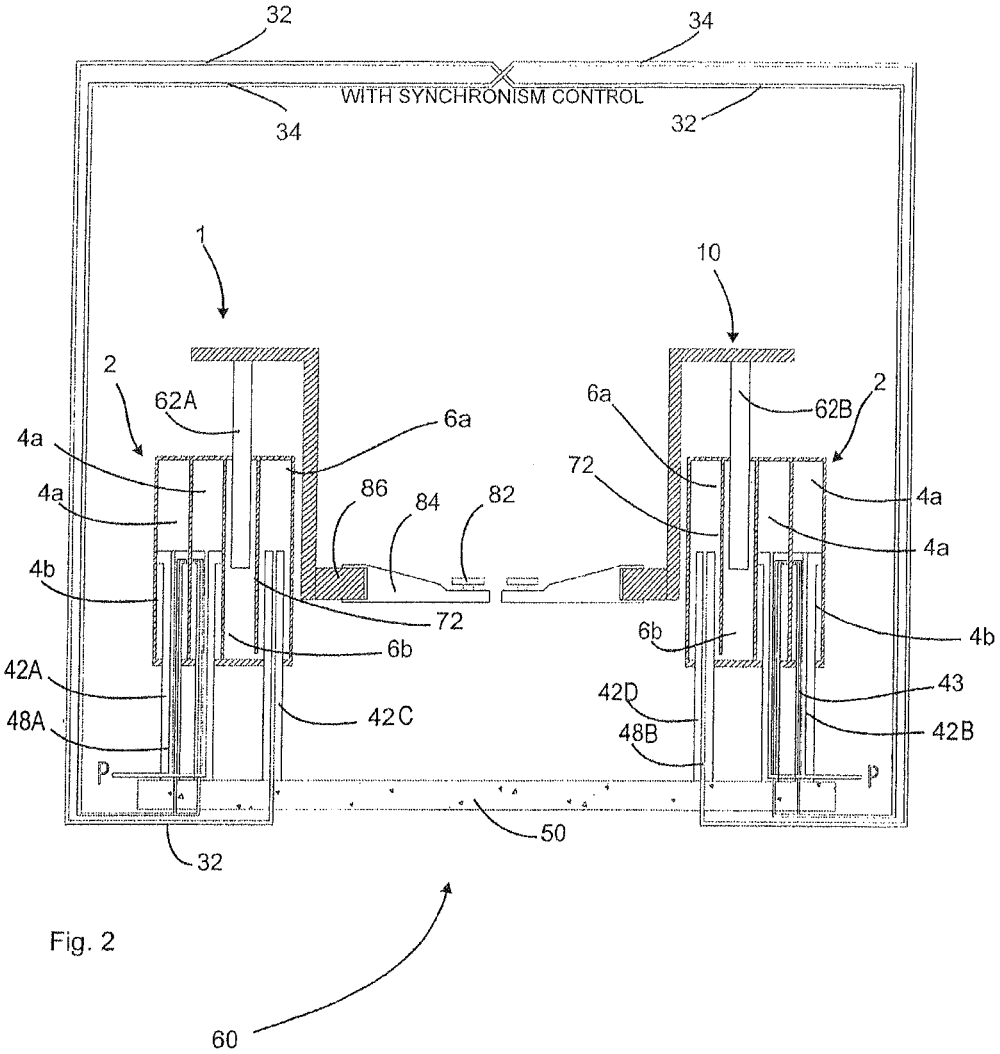
FIG. 2 is an illustration of an overfloor lifting platform with the use of the invention.

FIG. 2 is an illustration of a lifting platform, in this case an overfloor lifting platform 60, in which use is likewise made of the invention. In this case, as indicated by the sign P, the hydraulic medium is likewise supplied to the two lifting devices 1 and 10. The hydraulic medium passes through the channels 48 into the cavities 4*a* in each case. In this way, in the embodiment shown in FIG. 2, the two supply elements are present in a redundant manner in the case of the two lifting devices 1, 10. The two main carriers 2 move in this way upwards with respect to the supply elements 42A, 42B in each case and in this way the hydraulic medium can also be forced out of the lower space 4*b* in each case. In this way, it is preferable for the supply elements to have rod-like bodies in each case which preferably extend in the lifting direction. It is pointed out in this case that the first supply element 42A is also the first lifting element, since this first supply element has both the function of supplying the hydraulic medium, and the function of serving as a stationary lifting element with respect to which the main carrier 2 is movable.

In contrast to the embodiment shown in FIG. 1, however, in this case the hydraulic medium is conveyed not into the space adjacent in each case but by way of the connecting lines 32 and 34 in each case into the space 6 of the other lifting device 10 or 1 respectively in each case. In addition, a further channel 43 likewise extends in this case inside the supply element, as a result of which the conveying outlay is simplified. Expressed more precisely, further supply elements 42C, 42D (the supply elements situated on the inside in each case in the figure) are supplied with the hydraulic medium from the connecting lines 32, 34.

The channel 43 forms the connection to the other lifting device in each case. It is therefore preferable for the first lifting element 42A to have at least two channels which are preferably parallel to each other and in which the hydraulic medium flows in different directions, in particular opposed to each other.

It is evident that in the case of this embodiment two supply elements are present which are supplied with the hydraulic medium at the same time or in parallel respectively. In this way, a redundancy can be achieved. The hydraulic medium arrives in the spaces 6*a* and 6*b* by way of the supply lines 32, 34 (more precisely by way of an opening in the wall 72 in the interior of the main carrier) and has the effect that the two lifting elements 62A, 62B are forced upwards. A carrier 86 is arranged on the supply elements 62A, 62B and it has arranged on it in turn a holding arm 84 in a pivotable manner on which a carrying element 82 is provided which serves to lift the motor vehicle. The reference number 48A, 48B designates a further channel which is present in the supply element 42A, 42B and which in turn is used for supplying the hydraulic medium to the cavities 6*a* (of the other lifting device in each case). On account of this design it is possible to dispense with the guidance of a further connecting line in a particularly simple manner. In this way, a synchronism control is also achieved by the mutual connection of the lifting devices as shown.

Figure 3:
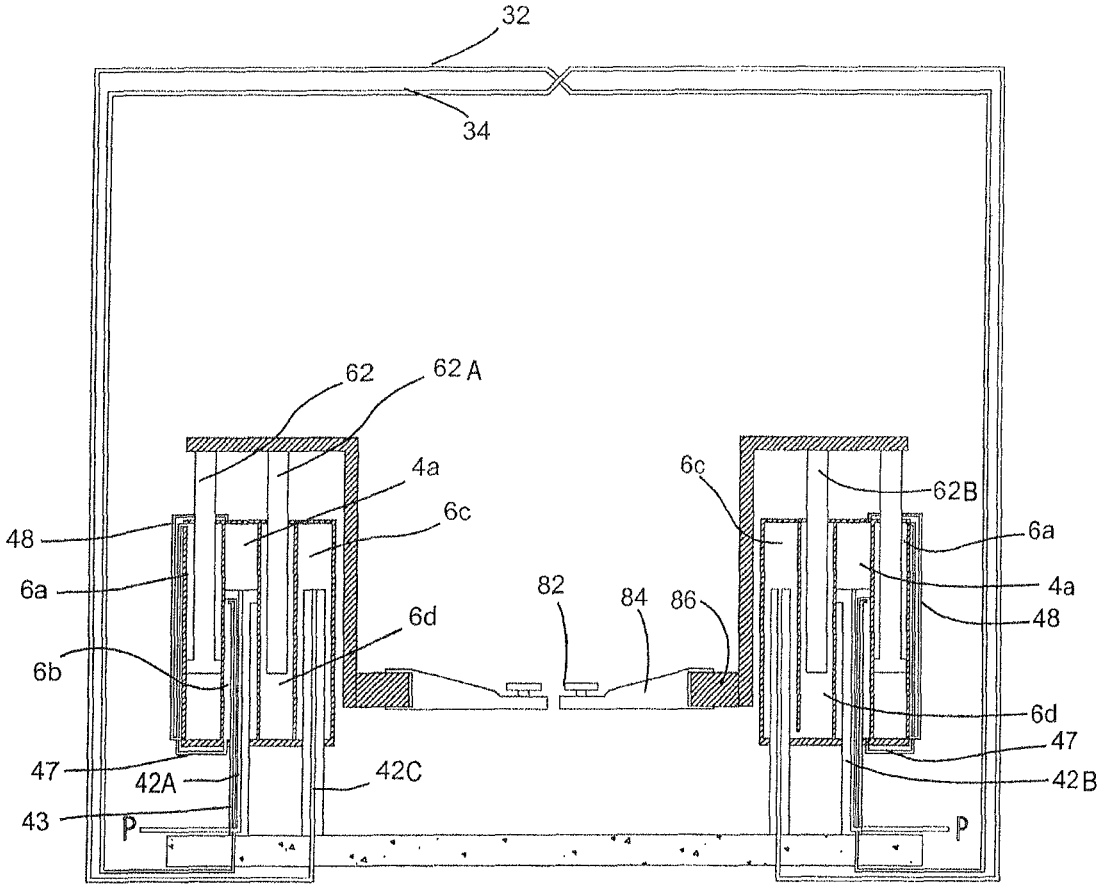
FIG. 3 is a further illustration of a lifting platform with the lifting device according to the invention.

FIG. 3 shows a further embodiment of a lifting platform according to the invention. In this case too, the hydraulic medium (reference letter P) is first supplied to the respective supply element 42A by way of a supply line and it arrives in turn in the cavity 4*a*. As a result of the movement described above, however, the hydraulic medium is also in turn forced out of the spaces 6*a* and 6*b* (which are connected to each other) through the other channel 43 of this supply element 42A and passes by way of the two connecting lines 32 and 34 alternately in each case to reach the other supply element 42B in each case (shown situated on the inside) and there passes into the spaces 6*c* and 6*d* (which are connected to each other by way of the line connection 48) and, in this way, it also causes the second supply element 62A (shown in the left in this case) to move out. In this way, the supply elements 62A, 62B are likewise present in this case in a redundant manner.

Figure 4A:
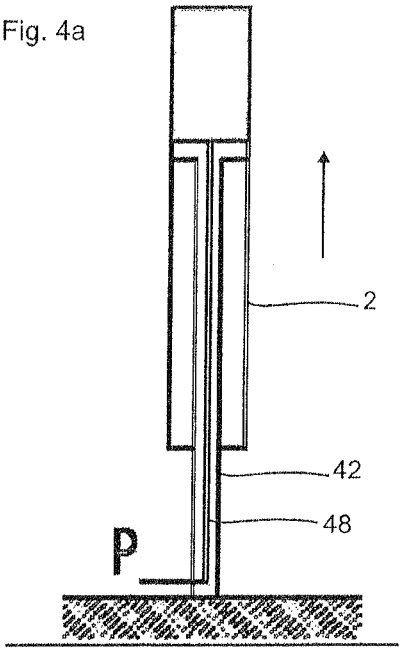
FIGS. 4*a* to 4*d* are four illustrations with respect to the development of a lifting device according to the invention.
Figure 4B:
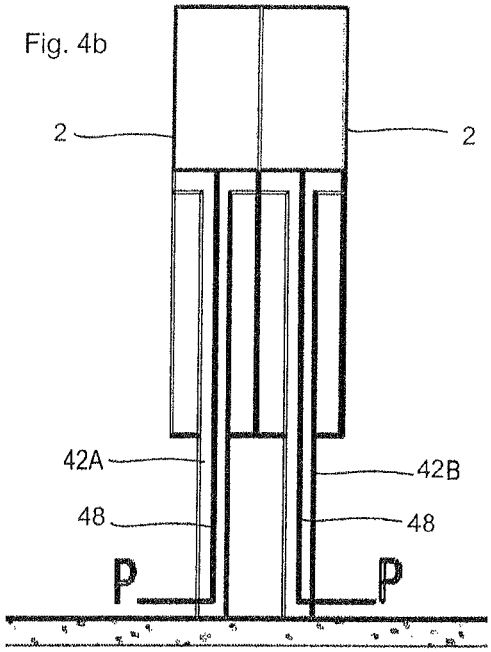

FIGS. 4*a* to 4*d* show a development of a lifting device according to the invention. In this case FIG. 4*a* shows only one arrangement comprising a supply element 42 and a main carrier 2. The main carrier 2 is moved upwards in this case on account of the supply of the hydraulic medium. FIG. 4*b* shows a redundant arrangement of two main carriers 6 which in this case, however, are advantageously assembled together. In this case the carrier 2 is likewise raised by the supply of the hydraulic medium (P).

Figure 4C:
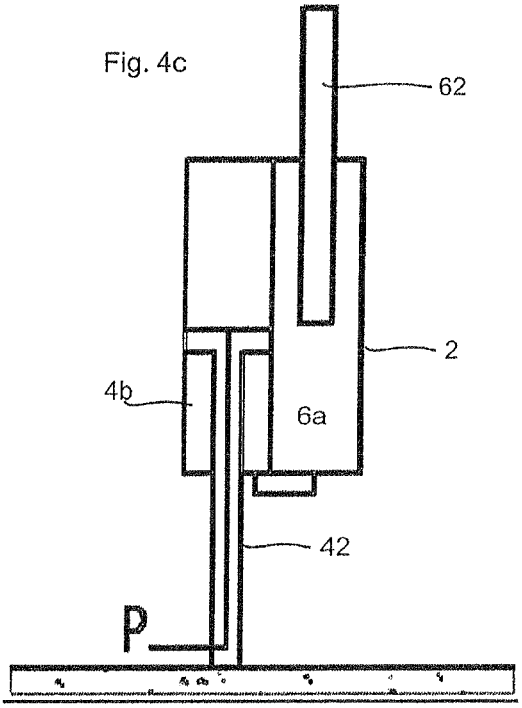
Figure 4D:
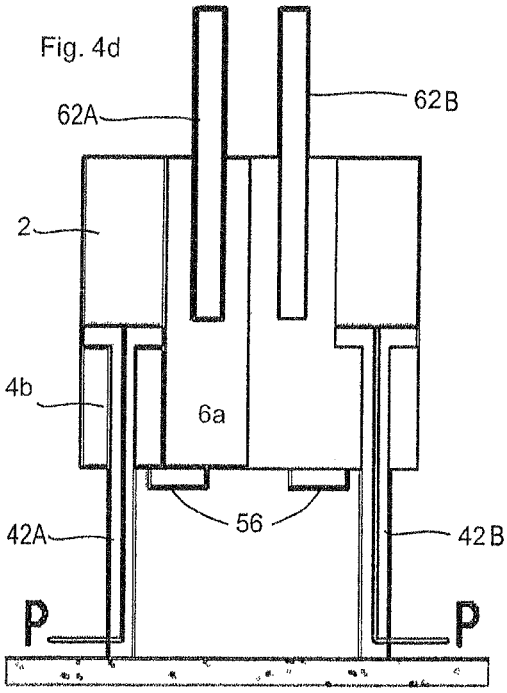

FIG. 4*c* is an illustration similar to FIG. 4*a*, in which case the two lifting elements 42A, 42B and 62A, 62B are moved out of the carrier 2 in each case (or the carrier 2 is moved out with respect to the lifting element 42 respectively). In the case of the embodiment shown in FIG. 4*d* both the supply elements 42A, 42B and the lifting elements 62A, 62B are present in duplicate. In this way, a redundancy of the system is achieved. A flow connection between the space 4*b* and the space 6*a* is achieved in this case by a connecting line 56. In this case too, however, the connection could also again be made by way of openings situated on the inside.

Figure 5:
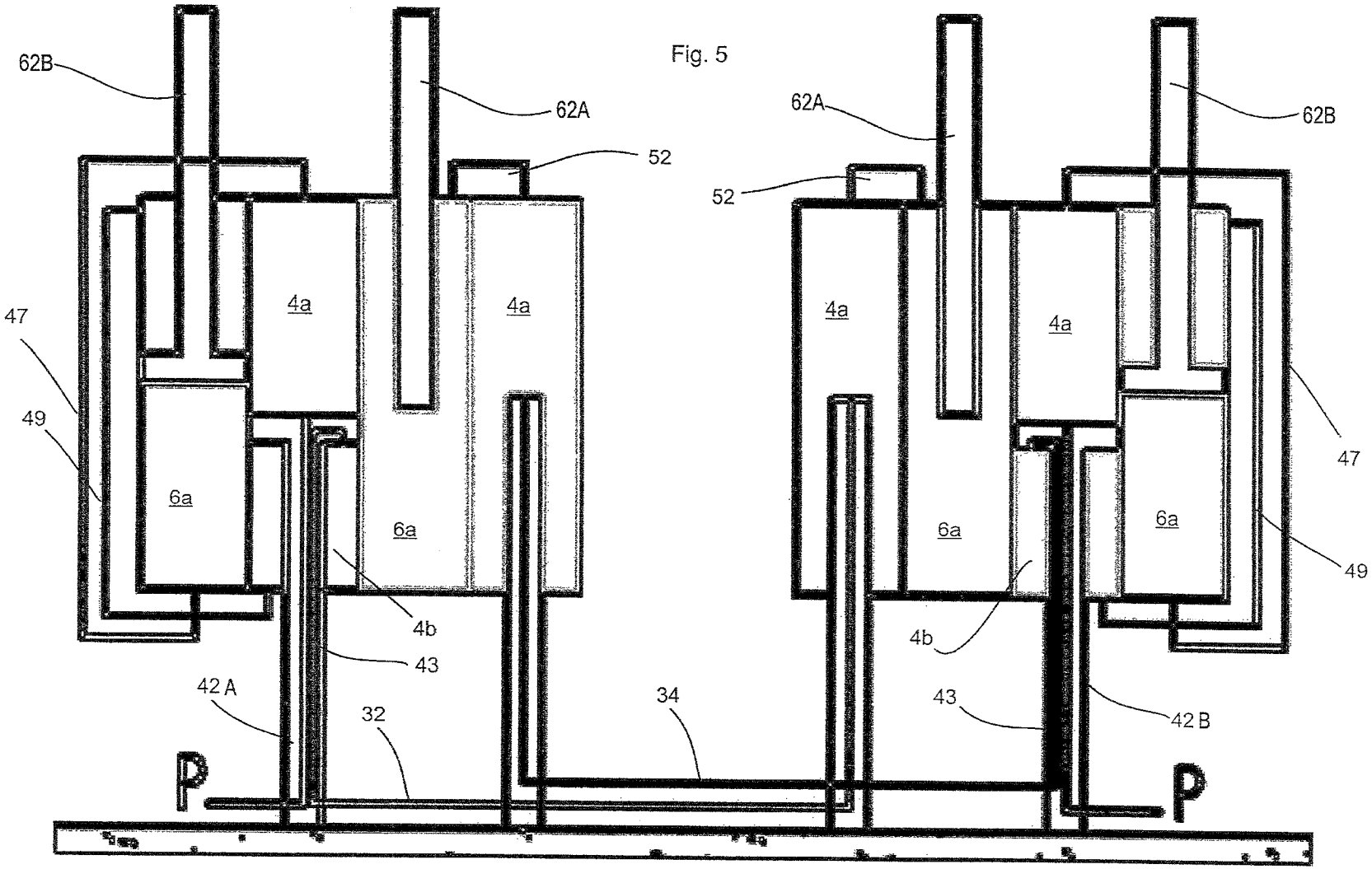
FIG. 5 shows a further design of a lifting platform according to the invention.

FIG. 5 shows a further design of a lifting platform according to the invention. In this case the hydraulic medium is again supplied to the two lifting devices 1, 10 by way of the supply elements 42A, 42B or the lifting elements respectively. The hydraulic medium passes from these supply elements 42A, 42B into the first partial spaces 4*a* in each case and has the effect that the two main carriers 2 are moved out upwards.

In addition, in this case the hydraulic medium also passes into the two rooms 6*a* directly by way of connecting lines 47 and has the effect that the second lifting elements 62B are moved out of the main carrier 2. The hydraulic medium is supplied from the two partial spaces 4*b* to the spaces 4*b* by way of a further connecting line 49 in each case and further in each case to the other lifting device in each case by way of the line 43 present in the first lifting elements in each case and the connecting lines 32, 34. In this case the hydraulic medium passes into the spaces 4*a* situated on the inside in each case by way of the two supply elements 42A, 42B shown situated on the inside in each case and, in this way, likewise assists the moving out of the main carrier. The hydraulic medium passes into the other partial spaces 6*a* (in this case again shown situated on the inside) in each case by way of the connecting lines 52, as a result of which the lifting elements 62A are also moved out.

In the case of the concepts of the lifting platform shown here, the lifting devices according to the invention are therefore used on the one hand, and in addition, a synchronism of the two lifting devices is also achieved by at least one and preferably at least two connecting lines between the lifting devices on the other hand.

The Applicants reserve the right to claim all the features disclosed in the application documents as being essential to the invention, insofar as they are novel either individually or in combination as compared with the prior art.

LIST OF REFERENCES

1 lifting device
2 main carrier/lifting device
4 cavity
4*a* part of the cavity
4*b* lower partial space
6, 6*a*, 6*b* cavities
10 lifting device
11 second lifting device
24 connecting line
32, 34 supply lines
42A, 42B, 42C, 42D lifting elements/supply elements

43 channel
44 supply opening
47, 49 connecting lines
48A, 48B channel
52, 56 connecting lines
60 overfloor lifting platform
62A, 62B lifting elements/supply elements
64 supply opening
72 wall
82 carrying element
84 holding arm
86 carrier
R1 direction of movement downwards
R2 direction of movement upwards
P hydraulic medium

The invention claimed is:

1. A lifting device capable of being actuated by a flowable medium, with a main carrier which forms a first cavity, with a first lifting element which is arranged at least locally inside the first cavity and which is movable in two mutually opposed directions of movement (R1, R2) with respect to the first cavity, with a first supply opening, in order to supply the flowable medium to the first cavity, wherein the first lifting element is moved in a first direction of movement (R1) by a supply of the flowable medium into the first cavity, wherein the main carrier has a second cavity which is arranged in a manner fixed in terms of movement with respect to the first cavity, and a second lifting element which is arranged at least locally inside the second cavity and which is movable in the two mutually opposed directions of movement (R1, R2) with respect to the second cavity, with a second supply opening in order to supply the flowable medium to the second cavity, wherein the second lifting element is moved in a second direction of movement (R2) by a supply of the flowable medium into the first cavity.

2. The lifting device according to claim 1, wherein the first cavity and the second cavity are connected to each other at least indirectly by a flow connection conveying the flowable medium.

3. The lifting device according to claim 1, wherein the lifting device is a hydraulically operated lifting device.

4. The lifting device according to claim 1, wherein at least one lifting element is arranged so as to be stationary.

5. The lifting device according to claim 1, wherein at least one lifting element has a channel for conveying the hydraulic medium.

6. The lifting device according to claim 1, wherein the first cavity has a first chamber as well as a second chamber, which are separated from each other by a piston element of the first lifting element.

7. An apparatus for lifting objects and, in particular, motor vehicles, with a carrier which has at least one carrying element to be arranged on the element to be lifted and with at least one lifting device according to claim 1, wherein the carrying element is coupled to at least one lifting element of the lifting device.

8. The apparatus according to claim 7, wherein the apparatus has a guide device for guiding a movement of the main carrier.

9. The apparatus according to claim 7, wherein the apparatus has a second lifting device and at least one connecting line is provided in order to convey the flowable medium from the first lifting device to the second lifting device.

10. The apparatus according to claim 9, wherein the second lifting device is also a lifting device according to claim 1, and the first lifting element of the first lifting device is connected to the second lifting element of the second lifting device by a connecting line for the flowable medium.

* * * * *